US006427458B1

(12) United States Patent
Fowler

(10) Patent No.: US 6,427,458 B1
(45) Date of Patent: Aug. 6, 2002

(54) APPARATUS AND METHOD FOR CLEARING AIR CONDITIONING DRAIN LINES

(76) Inventor: Claude Harry Fowler, P.O. Box 3466, Wilmington, NC (US) 28406

( * ) Notice: Subject to any disclaimer, the term of this patent is extended or adjusted under 35 U.S.C. 154(b) by 0 days.

(21) Appl. No.: 09/876,551

(22) Filed: Jun. 7, 2001

(51) Int. Cl.[7] ..... F25D 21/14

(52) U.S. Cl. ..... 62/150; 62/285; 137/565.23; 137/565.25

(58) Field of Search ..... 62/285, 286, 287, 62/288, 303, 150; 137/565.23, 565.25, 565.12; 417/53, 440, 534

(56) References Cited

U.S. PATENT DOCUMENTS

| | | | | |
|---|---|---|---|---|
| 635,961 A | | 10/1899 | Hasson | |
| 717,572 A | | 1/1903 | Hellums et al. | |
| 999,346 A | | 8/1911 | Simmons | |
| 2,697,842 A | | 12/1954 | Meyer | 4/255 |
| 5,085,244 A | | 2/1992 | Funk | 137/240 |
| 5,090,296 A | * | 2/1992 | Todd | |
| 5,666,690 A | | 9/1997 | Domansky | 15/406 |
| 5,722,458 A | | 3/1998 | Potter | 137/625.47 |
| 5,964,238 A | | 10/1999 | Junkin | 137/15 |
| 6,041,611 A | | 3/2000 | Palmer | 62/286 |
| 6,068,023 A | | 5/2000 | Potter | 137/625.47 |

FOREIGN PATENT DOCUMENTS

JP 05321836 A * 12/1993

* cited by examiner

*Primary Examiner*—Chen-Wen Jiang
(74) *Attorney, Agent, or Firm*—Michael E. Mauney

(57) ABSTRACT

A device to clear a blockage from a drain line draining condensation from an air handler in an air conditioner or heat pump. A pump with check valves attaches to one end of a drain line which drains condensation from an air handler for an air conditioner or heat pump. A handle on the pump is used to create respectively a vacuum or pressure within the pump which is communicated to the drain line. When sufficient vacuum or pressure is created, it will dislodge a blockage in the drain line allowing the drain line to naturally drain. A valve is placed at one end of the pump which allows accumulated liquid in a collection pan to be pumped from the collection pan in the process of clearing condensation from the air handler.

9 Claims, 4 Drawing Sheets

APPARATUS AND METHOD FOR CLEARING AIR CONDITIONING DRAIN LINES

FIELD OF THE INVENTION

This invention relates to an apparatus and method for clearing of air conditioning drain lines. More specifically, it relates to a pump with a connection for clearing blocked condensate drain lines and drain pans on air conditioners and refrigeration equipment.

BACKGROUND OF THE INVENTION

Air conditioning systems typically have evaporator coils that are used in the cooling of air to be distributed by the system through the building or area to be cooled. These evaporator coils collect condensate formed by humid air contacting the cold metal on the evaporator coils. Water in the humid air condenses on the coils, which then drips into a drain pan usually placed beneath the air conditioning system. The drain pan typically has an outlet connected to a pipe, which directs it to a drain, sewer system, or an outside area where water can drip without damaging the building.

The drain line from the drain pan frequently clogs due to algae or fungus growing in the lines or from debris blocking the drain line. If the drain line is completely blocked, the condensate can overfill the drain pan, spilling and causing water damage to a surrounding area. Sometimes the primary drain pan may be situated inside a secondary drain pan. A safety float switch may be positioned on the secondary drain pan so that, as that drain pan fills, the float switch will shut off the air conditioning system preventing further accumulation of water hence, damage from water spillage. Sometimes the drain pans are situated so spillage may not be noticed. For example, an air handler may be positioned in a crawl space in an attic area and, until the insulation is soaked through and the ceiling material is also soaked through, there would be little, if any, reason to know water spillage was occurring. However, at that point, substantial damage would have occurred before the drain line could be unblocked.

Blockages occur in other types of fluid-carrying lines, such as plumbing or industrial steam lines. Consequently, a variety of inventions are known in the art from such things as a plunger, sometimes called a plumber's helper, or a plumber's snake. Typically, these devices operate either by applying a mechanical force to a blockage, like a plumber's snake, or by applying a hydraulic force such as a plunger. However, a heating and air conditioning drain line is typically made of a more delicate material than are water or sewage-carrying lines. Moreover, these drain lines are relatively small in diameter and may traverse relatively large distances from the air handler or evaporator coil where the condensation collects to the outside point where the condensation drains by means of the drain line. Consequently, things like plumber snakes or plungers are not helpful to clear blocked air conditioning drain lines.

Currently, a heating and air conditioning service technician has several options when confronted with a blocked drain line. He can clean out the drain pan and then apply air pressure or apply suction to drain pan end of the drain line in hopes of clearing a blockage, or he can cut the drain line in order to apply pressure or suction. This can lead to spillage from the drain line and a repair or partial replacement of the drain line is required after it is cut. Or at the drain end of the drain line he can apply pressure or suction. Most service technicians use his or her mouth to do this with potentially unpleasant or unhealthy consequences.

Several devices have proposed placing special valves in a drain line to facilitate the clearing of air conditioning drain lines. Potter, U.S. Pat. No. 6,608,023; Palmer, U.S. Pat. No. 6,041,611; Junkin, U.S. Pat. No. 5,964,238; and, Potter, U.S. Pat. No. 5,722,458, all propose placement of valves in a drain line to allow introduction of either a suction or air pressure or a hydraulic pressure to clear a drain line. Domansky, U.S. Pat. No. 5,666,690, proposes the use of a $CO_2$ power device using a 12-gram $CO_2$ cylinder to clear a drain line.

More generally, a variety of different types of pumps that induce either a pressure or a suction into a drain system are proposed for cleaning of drain lines. For example, Meyer, U.S. Pat. No. 2,697,842, proposes a combination hand and air force pressure pump and plunger for use generally in the same fashion as a standard plunger or plumber's helper. Hasson, U.S. Pat. No. 635,961, also proposes using a cylinder with a piston to create either a pressure or suction used to clear pipes used for transporting of beer. Simmons, U.S. Pat. No. 999,346, proposes a specialized device for cleaning a smoking pipe. Despite this work there is still a need for a device to help unblock or clean a drain line for heating and air conditioning systems.

Most systems are not equipped with a valve as described in the Palmer '611 or Potter '023 and '458 patents to facilitate introduction of a pressure or suction into a line. Consequently, a service technician would have to install such a valve or fall back on the expedients that have been employed in the past such as, cutting the drain line in order to induce a pressure or suction or use a mechanical cleaning device. Consequently, it would be an advance in the art to provide both an apparatus and a method, which can be used with standard heating and air conditioning units, to clean a drain pan and drain pipe that has become clogged. This invention consists of a rod connected to a piston inside of the cylinder. The rod and piston fits inside the circular cylinder and the piston is fitted with a gasket to slide within the inner circumference of the cylinder. There are connections at each end of the cylinder, with these connections designed for air and fluid-tight connections to hoses, pipes, or other connecting means. At one end of the cylinder that is connected to a drain pipe is an adjustable gasket-like fitting that will fit around in an air and fluid-tight manner to an end of the drain pipe. To use the device, a technician will go to the outside end of the drain pipe, connect the cylinder to the drain pipe after either all air or fluid has been exhausted from the cylinder or the cylinder has been filled with air or fluid, depending on the choice of the technician. One would then use the rod with the interior piston to create either a hydraulic pressure or a suction by moving the rod hence, the piston within the cylinder. This pressure or suction will be communicated by the connection to the drain pipe where the pressure or suction respectively created by the movement of the piston within the cylinder will be fluidly communicated to the drain pipe. This will create enough force to dislodge the obstruction in the drain pipe and to allow water to freely drain through the drain pipe into the outside area. The device may also be used to clear accumulated liquids from a drain pan or from an overflow drain pan. One could use the rod within the cylinder to fill the cylinder with liquid and then to expel the liquid into a container.

DETAILED DESCRIPTION OF THE DRAWINGS

Figure 1:
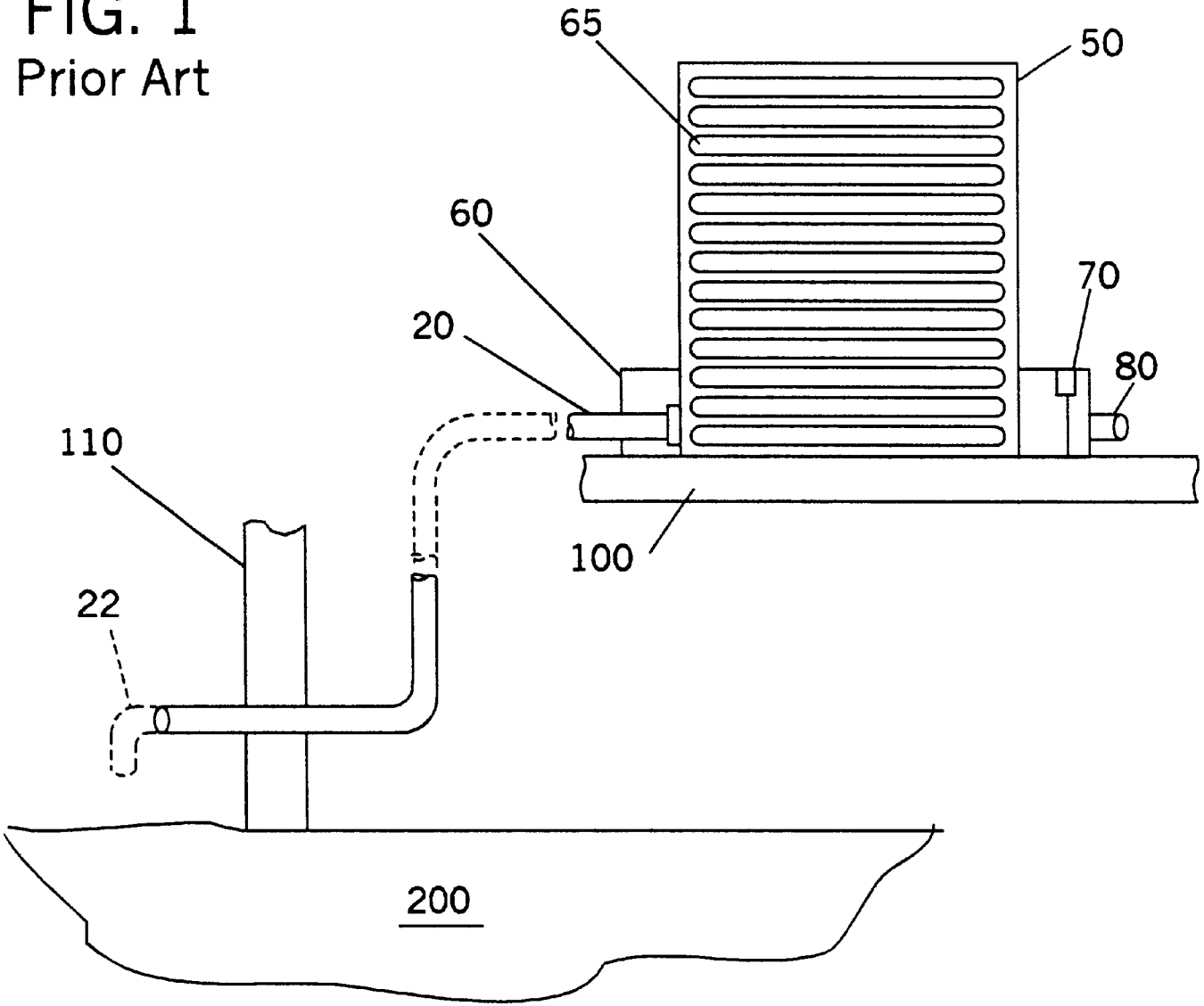
FIG. 1 Prior Art
FIG. 1 shows an air handler and drain line.

FIG. 1 shows an air handler (50) mounted in an attic space (100). Ordinarily, the air handler (50) is entirely enclosed with a coil (65) contained within the air handler (50). A drain pipe (20) drains the bottom of the air handler (50). The drain pipe (20) is ordinarily made of three-quarter inch PVC pipe. It runs from the place of mounting in the air handler (50), here, the attic (100), to a place where condensation collecting in the air handler (50) can be drained by the drain pipe (20). Most commonly, the drain pipe (20) is directed through an outside wall (110) to an outside area at or near the ground (200). Many air handlers (50) sit in a secondary drain pan (60), which itself may be drained by a second three-quarter inch PVC drain pipe (80). In the event the primary drain pipe (20) becomes clogged, the secondary drain pan (60) will gradually fill with water unless it is also drained by the secondary drain pipe (80). As a final precautionary measure, there is usually a float switch (70). Should the water level rise in the secondary drain pan (60), the float switch (70) will rise with it until it reaches a tripping point to turn off a switch, which stops the air handler (50) from functioning hence, stops further condensation from collecting on the coils (65).

Not all air handlers (50) have either the secondary drain pan (60), the secondary drain pipe (80), or the float switch (70). Commonly, there is at least a secondary drain pan (60) with a float switch (70) outside of the air handler (50). The service man will receive a call when the air handler (50) stops functioning, perhaps because the float switch (70) has tripped, or when a homeowner notices water leakage indicating a problem with the air handler (50). A technician will come to the attic (100) where the air handler (50) is mounted and will visually inspect it to see if there is a water accumulation problem. If so, the technician can go to the terminal end of the drain pipe (20) placed outside the outside wall (110) and above the ground (200) and blow or suck on the end of the drain pipe (20) hoping to break up any blockage. As an alternative, a section of the drain pipe (20) may be cut. If the blockage is upstream from the point of cutting, the pipe can be blown into or a mechanical device may be employed to break the blockage and to allow the accumulated water to drain. If the blockage is downstream, again air pressure or a mechanical device may be employed to break up the blockage. Cutting the drain pipe (20) creates a problem in that the accumulated water must then drain through the cut in the drain pipe (20) and provision must be made for collection of this excess water without it spilling into the surrounding building structures. If there is a secondary drain pan (60), sometimes this drain pan will be full or nearly full of water and it must be drained or emptied before work can begin. Sometimes, at the outside terminal of the drain pipe (20), it will simply terminate as is shown in the drawing. At other times, an elbow joint (22) (shown in dotted lines) will be employed to direct drainage more directly toward the ground (200) or toward a splash pan. Commonly, somewhere in the drain pipe (20) there is a trap or elbow joint (not shown) where a blockage is most likely to occur. This trap is ordinarily placed close to the air handler (50). However, an air handler typically is in a tight area, crawl space, attic, or other area where access to the blockage may be difficult Consequently, if the blockage in the drain pipe (20) can be cleared from the outside terminal of the drain pipe (20), it will greatly facilitate the technician's job.

Figure 2:
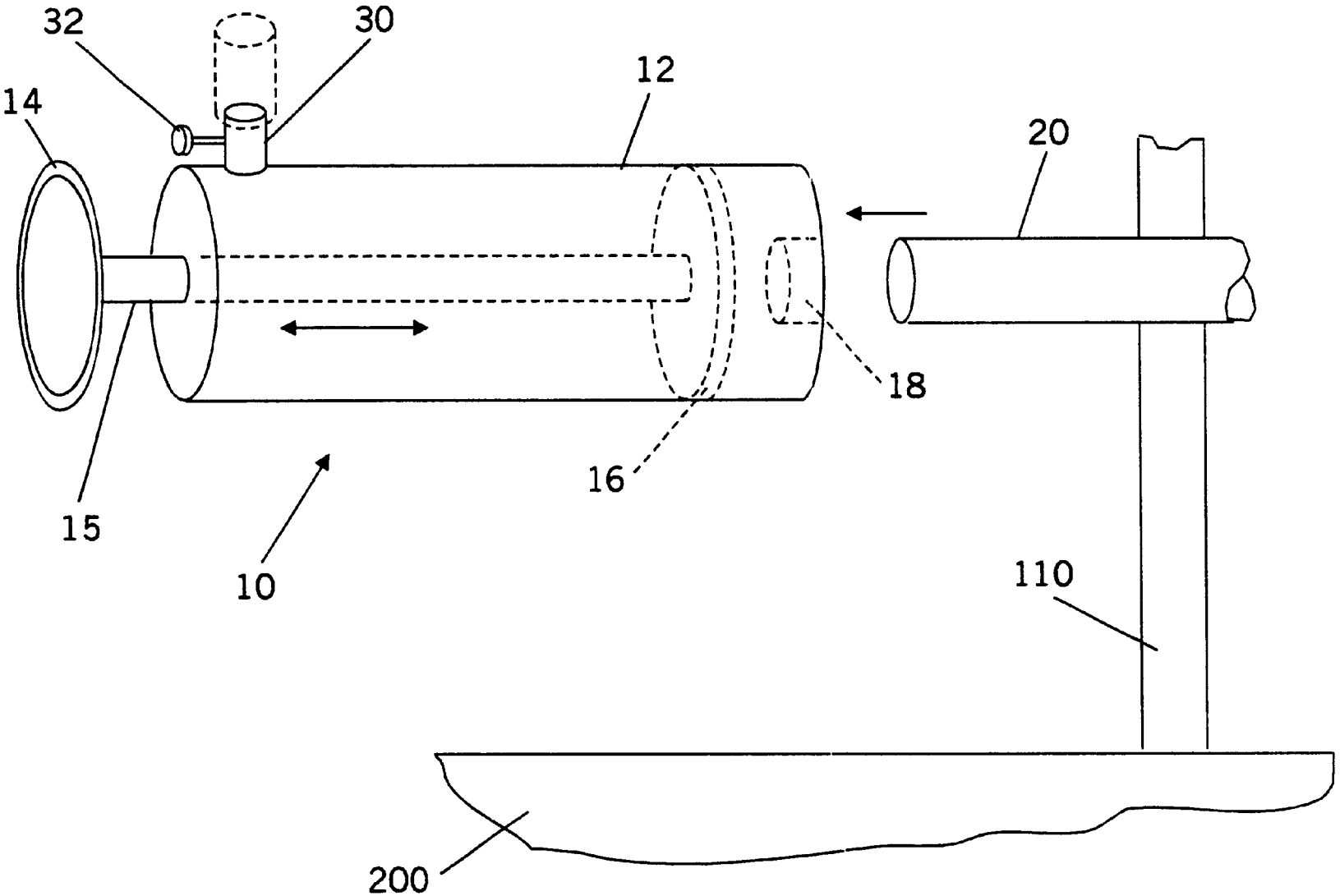
FIG. 2 shows an embodiment of the current invention in use.

FIG. 2 shows an embodiment of current drain line clearing device (10). In this embodiment, it is not unlike a standard piston cylinder pump. There is a cylinder (12) with a handle (14) and a rod (15) terminating in a circular piston (16), which will tightly fit on the inside of the cylinder (12). The piston (16) will have airtight gaskets or rings so as to prevent air or liquid from passing up the walls of the cylinder (12) from either above or below the position of the piston (16). On the cylinder (12) near the end where the handle (14) and the rod (15) enter the cylinder (12), there is an outlet (30) with a stop valve (32). At the end of the cylinder (12) opposite from the handle (14) is a connection (18). The connection (18) is sized to fit a three-quarter inch pipe with appropriate gaskets surrounding the connection (18) so that an airtight fit can be maintained when a three-quarter inch drain pipe (20) is placed into the connection (18). In operation, the handle (14) will be pulled to withdraw the piston (16) to a position at or near the end of the cylinder (12) opposite from the connection (18). When the cylinder (12) is fully or close to fully filled with air, a three-quarter inch drain pipe (20) will be fitted in the connection (18) and the handle (14) will be pushed to create a compression on the air contained within the cylinder (12). An airtight or close to airtight seal will be in place and maintained by pressing the cylinder (12) against the three-quarter inch drain pipe (20) at the connection (18). The handle (14) is then pushed to insure further compression of the air within the cylinder (12). The air will seek to escape through the three-quarter inch drain pipe (20). Most drain pipes (20) for air handlers or air conditioners do not experience solid clogs. There is no solid or particulate matter that ordinarily passes through the pipe, unlike plumbing or industrial pipes where solid matter may become wedged in the pipe. Rather, the blockage here is usually due to a build up of algae or other plant growth over time. This type of build up is usually fairly easily dislodged without generating high pressure. Indeed, the plastic pipe used for construction of the drain pipes (20) for air handlers (50) is usually not durable enough to sustain high degrees of pressure. If the outside drain pipe (20) becomes clogged, the technician will simply take the drain line clearing device (10) to the point on the outside wall (110) where the drain pipe (20) exits. The three-quarter inch PVC drain pipe (20) will be placed into the connection (18) and pressure applied to create an airtight seal. The handle (14) will be pushed activating the rod (15) and the piston (16) to pressurize air contained within the distal portion of the cylinder (12) from the handle (14). This will force air through the drain pipe (20) dislodging the solid matter, usually algae growth, within the pipe and allowing drain age to begin through the drain pipe (20). Conversely, the handle (14) could be withdrawn from the cylinder (12) creating a suction within the cylinder (12) communicated by the connection (18) to the drain pipe (20). This suction can dislodge algae or other plant growth within the pipe allowing the drain pipe (20) to drain the air handler (50) (not shown).

Figure 2A:
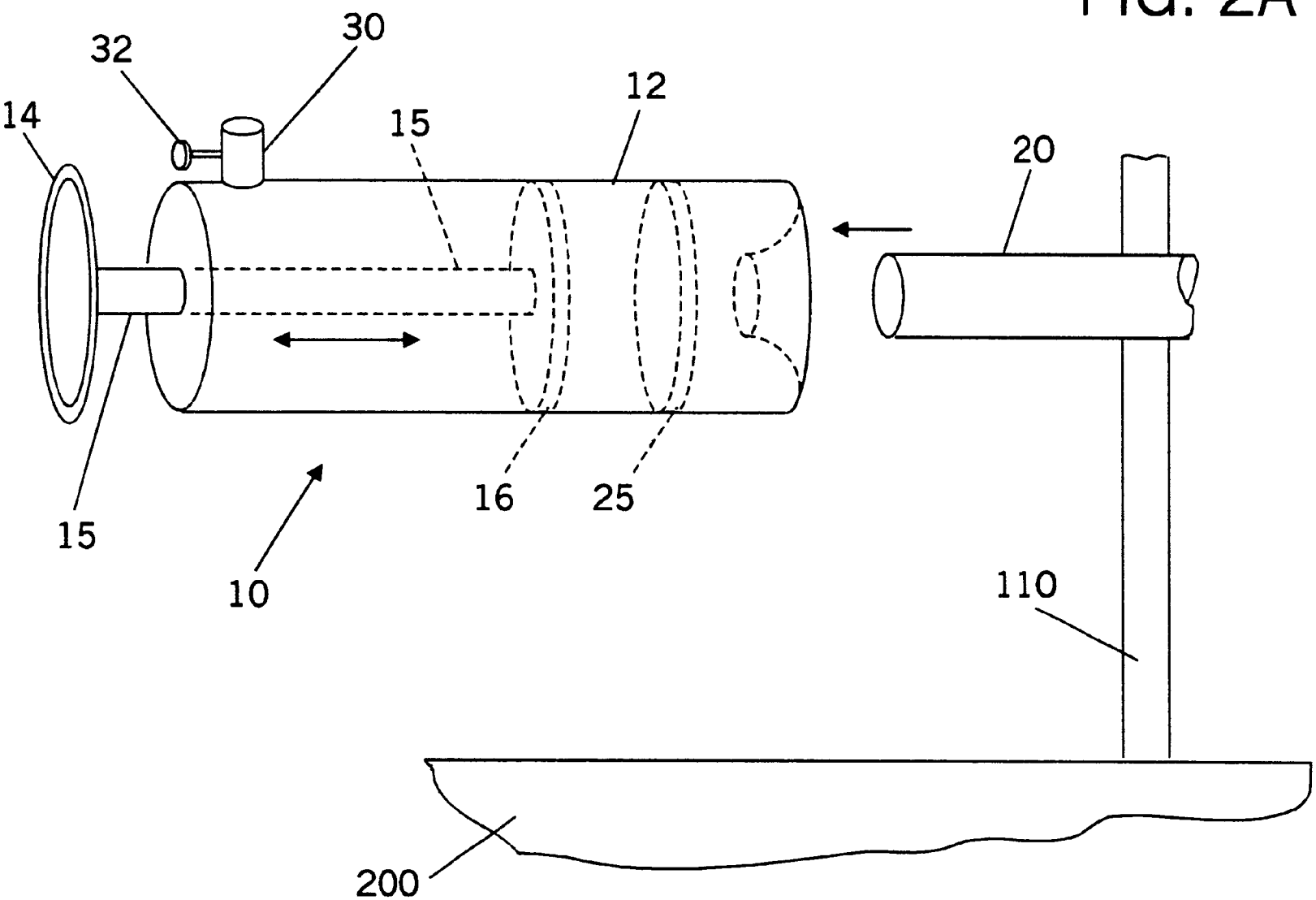
FIG. 2A shows the preferred embodiment of the current invention.

The preferred embodiment of this invention shown in FIG. 2A operates somewhat differently than the embodiment shown in FIG. 2. Ordinarily, only one end of the drain pipe (20) will be exposed. This ordinarily is the end that terminates at the point the drain pipe (20) drains—usually, outside the outside wall (110) of a home. In order to obtain access to the other end of the drain pipe, it would frequently require part of the outside cover of the air handler (50) be removed or a portion of the drain pipe (20) be cut. The air handler (50) will ordinarily be placed in a ceiling, sometimes more than one story removed from the ground. This means that the drain pipe (20) will extend from the air handler (50) down one or two stories, sometimes more, before it terminates in the outlet placed outside near the ground. As stated above, typically three-quarter-inch PVC pipe is employed for the drain pipe (20). So sometimes 25 to 50 feet of drain pipe (20) will run from the air handler (50) to the outside place of drainage. Consequently, a substantial amount of volume or "dead space" will be contained within the drain pipe (20) from its point of origination in the air handler (50) to its point of termination somewhere near the ground (200) outside the wall (110) of the house. Because the blockage most commonly occurs in a trap or elbow joint in the drain pipe (20), usually near the air handler (50) there may be 30 or 40 feet of the drain pipe (20) extending from the terminal end somewhere near the ground (200) to the point of blockage. This is a substantial amount of dead space. In the preferred embodiment of the drain pipe clearing device (10), it will be designed to employ a suction to clear the drain pipe (20). Because of the amount of "dead space" in the drain pipe (20) between the point the suction will be applied and the point of origination of the drain pipe (20) in the air handler (50), a substantial volume of air must be removed from the drain pipe (20) in order to create a suction at the point of blockage. If the drain pipe clearing device (10) was very large so that the cylinder volume on the drain pipe clearing device (10) was equal to or greater than the dead space in the drain pipe (20), then the device as shown in FIG. 2 could be used. However, such a cylinder size would be unwieldy and not practical. Consequently, in the preferred embodiment of the drain pipe invention, check valves are employed to control the flow of air in one direction. Check valves of this type are common in pumps. For example, in a standard bicycle pump, a check valve was employed to allow the pump to force air within the bicycle tire, but not to let already compressed air in the tire escape through the pump. Likewise, there are check valves employed so that successive strokes using the handle (14), the rod (15), and the piston (16) may be used to evacuate the dead space in the drain pipe (20). Here, a rubber disk (25) is employed near the connection (18) of the drain clearing device (10) to act as a check valve. This allows air or liquid to flow into the cylinder (12) through the connection (18). However, flow in the other direction is not permitted. Hence, one may use the handle (14) in a stroke withdrawing it from the connection (18) creating a suction within that portion of the cylinder (12) which will pull air from the drain pipe (20) into the cylinder (12). The rubber disk (25) prevents the air from flowing back into the pipe (20) when the stroke direction using the handle (14) and the rod (15) is reversed. In this embodiment of the drain line clearing device (10), the piston (16) also acts as a check valve. As with the rubber disk (25), the piston (16) is constructed so it will flex in one direction to allow passage of fluid or air, but not in the other direction. Here, the piston (16) is constructed so that, when it is moving toward the connection (18) of the drain clearing device (10), fluid or air may freely pass the piston (16). Although, when the piston (16) is being withdrawn from the connection (18) of the drain clearing device (10), it creates a tight seal within the drain clearing device (10) cylinder (12). This creates a vacuum in the volume of the cylinder (12) between the piston (16) and the connection (18). Hence, a suction is created at the connection (18) of the drain clearing device (10). When the piston (16) has approached the end of the cylinder (12) opposite from the connection (18) of the drain clearing device (10), the direction of the stroke is reversed, then the rubber disk (25) acts as a check valve as described above. The outlet (30) and the stop valve (32) are employed to allow the air or fluid to escape from the cylinder (12) during successive strokes. In this way, successive strokes withdraw more and more air or liquid, from the pipe (20) creating a greater and greater vacuum within the pipe. This forces either liquid or air from the air handler (50) into the drain pipe (20) dislodging the blockage that has formed somewhere in the drain pipe (20).

Figure 3:
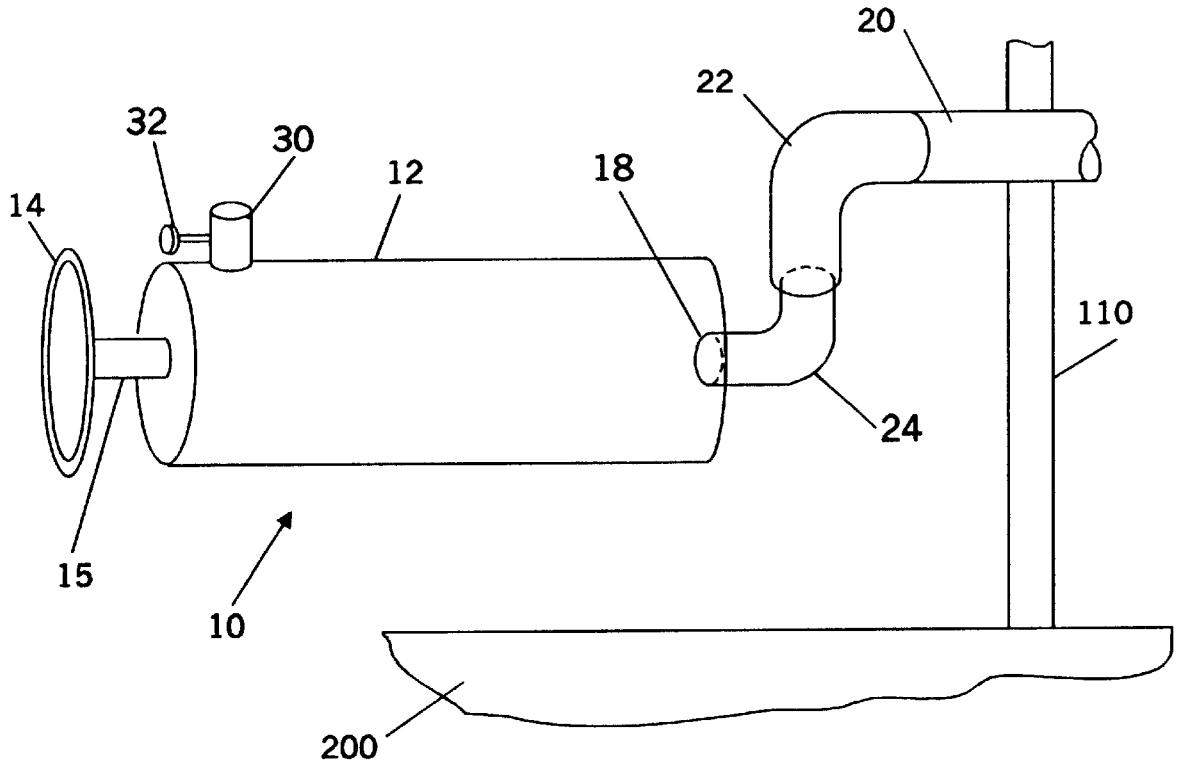
FIG. 3 shows the current invention in use to clear a drain pipe.

FIG. 3 shows an alternative way of employing either embodiment of the drain line clearing device (10) when the drain line (20) is equipped with an elbow joint (22). Here, a second L-shaped connecting piece (24) is designed to fit within the connection (18) on the drain line clearing device (10) while also fitting within the opening in drain pipe (20) below the elbow joint (22). By employing the L-shaped connecting piece (24), the drain line clearing device (10) can be used to apply either a pressure or a suction to the drain line (20) no matter how the drain line terminates. The L-shaped connecting piece (24) can be made of rigid PVC materials or could be made in part of rigid materials and in part of flexible heavy hose-like material. The flexible heavy hose material will provide the greatest degree of flexibility in terms of using the drain line clearing device (10) to attach to an odd shape or oddly angled drain pipe (20). As described in FIG. 2, the handle (14) will be either extended or withdrawn as is required to create either a pressure or a suction within the drain pipe (20) using the connection (18) and the L-shaped connecting piece (24) to connect to the elbow fitting (22) of the drain pipe (20).

Figure 4:
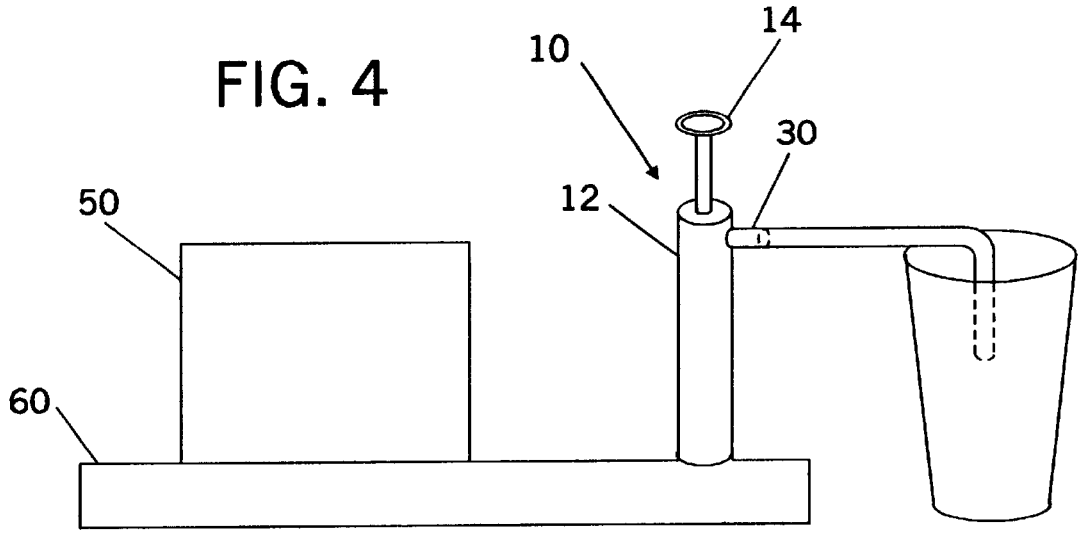
FIG. 4 shows the current invention in use to clear a drain pan.

FIG. 4 shows how the preferred embodiment of the drain line clearing device (10) may be used to withdraw fluid from a secondary drain pan (60) mounted around an air handler (50). The check valve (25) (not shown) is in place in this embodiment of the invention. The connection (18) (not shown) is simply placed in the secondary drain pan (60). The handle (14) is withdrawn from the cylinder (12), which fills with liquid until the liquid is at or near the outlet (30). The handle (14) is then forced downward. The check valve (25) (not shown) prevents any liquid from leaving the cylinder (12). The piston (16) (not shown) flexes to allow it to pass through the liquid until it is at or near the connection (18) (not shown). The handle (14) is again withdrawn as the piston (16) (not shown) prevents the liquid from passing past its point in the cylinder (12), so liquid is now forced out of the outlet (30). The disk (25) (not shown), acting as a check valve, again allows liquid to fill the cylinder (12) as the handle (14) is being withdrawn. Each stroke of the handle (14) up and down forces a volume of liquid that is filling the cylinder (12) out of the outlet (30) into a waiting bucket or drain area. In this fashion, one is able to use this device to clean a secondary drain pan (60) at or near an air handler (50) that is filled with liquid.

I claim:

1. A device to clear a blockage from a drain line draining condensation from an air handler in an air conditioner or a heat pump comprising:

(a) a pump for fluid or gas with a cylinder, a piston disposed within said cylinder, a rod extending from said piston toward a first end of said cylinder and terminating in a handle outside of said cylinder;

(b) at a second end of said cylinder, an outlet disposed for a gas or fluid tight fitting to a terminal end of a drain line;

(c) at said first end of said cylinder, a valve, whereby said valve may be opened to allow fluid or air flow from said cylinder to an area outside of said cylinder.

2. A device to clear a blockage from a drain line draining condensation from an air handler in an air conditioner or a heat pump of claim 1 further comprising a connection to fit within said outlet, said connection designed for connecting to a terminal end of the drain line.

3. A device to clear a blockage from a drain line draining condensation from an air handler in an air conditioner or a heat pump of claim 2 wherein in said cylinder and disposed between said piston and said outlet is a first check valve to allow fluid or gas flow from said outlet into said cylinder but to prevent flow of a fluid or gas from said cylinder past said check valve and through said outlet.

4. A device to clear a blockage from a drain line draining condensation from an air handler in an air conditioner or a heat pump of claim 3 wherein said piston further comprises a second check valve, said second check valve oriented to allow fluid or gas flow from said outlet past said second check valve and piston into said cylinder but to prevent fluid or gas flow past said second check valve toward said outlet.

5. A device to clear a blockage from a drain line draining condensation from an air handler in an air conditioner or a heat pump of claim 4 wherein said outlet fits over a three-quarter inch drain line and where said connection connects said outlet to a three-quarter inch drain line.

6. A device to clear a blockage from a drain line draining condensation from an air handler in an air conditioner or a heat pump of claim 5 wherein said valve connects to a hose whereby said pump may be used to pump liquid from a drain pan to a receptacle.

7. A method to clear a blockage from a drain line draining condensation from an air handler in an air conditioner or a heat pump comprising:

(a) attaching a pump, using a connection designed for connecting to a terminal end of a drain line at an outlet on said pump, to a terminal end of a drain line for draining condensation from an air handler in an air conditioner or heat pump;

(b) withdrawing a handle from said pump creating a vacuum in said pump fluidly communicated to said drain line;

(c) repeatedly withdrawing said handle to create a sufficient vacuum in said drain line to dislodge a blockage in said drain line allowing accumulated condensation in said air handler to drain from said drain line.

8. A method to clear a blockage from a drain line draining condensation from an air handler in an air conditioner or a heat pump of claim 7 further including the step of adding a valve to said pump for draining liquid accumulating in said pump during a pumping action.

9. A method to clear a blockage from a drain line draining condensation from an air handler in an air conditioner or a heat pump of claim 8 further comprising said steps of adding a first check valve in said pump to allow fluid or gas flow from said outlet into said pump but to prevent flow of fluid or gas from said pump past said first check valve and adding a second check valve to said pump, said second check valve oriented to allow fluid or gas flow from said outlet past said said check valve into said cylinder but prevent fluid or gas flow past said second check valve toward said outlet.

* * * * *